US006605024B2

(12) United States Patent
Stearns

(10) Patent No.: US 6,605,024 B2
(45) Date of Patent: Aug. 12, 2003

(54) METHODS AND APPARATUS FOR EXERCISING A PERSON'S QUADRICEPS MUSCLES

(76) Inventor: Kenneth W. Stearns, P.O. Box 55912, Houston, TX (US) 77255

( * ) Notice: Subject to any disclaimer, the term of this patent is extended or adjusted under 35 U.S.C. 154(b) by 8 days.

(21) Appl. No.: 09/917,006

(22) Filed: Jul. 27, 2001

(65) Prior Publication Data

US 2003/0022771 A1 Jan. 30, 2003

(51) Int. Cl.[7] ..... A63B 26/00

(52) U.S. Cl. ..... 482/142; 482/92; 482/93; 482/136; 482/97

(58) Field of Search ..... 482/142, 92–94, 482/97–100, 133–140

(56) References Cited

U.S. PATENT DOCUMENTS 5,827,154 A * 10/1998 Gill ..... 482/9
6,220,993 B1 * 4/2001 Sencil ..... 482/97
6,454,680 B1 * 9/2002 Taimela ..... 482/10

* cited by examiner

*Primary Examiner*—Nicholas D. Lucchesi
*Assistant Examiner*—Lou Baker Amerson

(57) ABSTRACT

An exercise machine includes a frame designed to rest upon a floor surface; a back rest mounted on the frame; and a foot platform mounted on the frame. At least one of the foot platform and the back rest is movably mounted on the frame in such a manner that a person may rest his back against the back rest and exercise his quadriceps muscles in isolated, closed chain fashion. A resistance device is preferably provided to resist an increase in distance between the user's hips and the user's feet due to straightening of the user's legs at the knees.

10 Claims, 15 Drawing Sheets

METHODS AND APPARATUS FOR EXERCISING A PERSON'S QUADRICEPS MUSCLES

FIELD OF THE INVENTION

The present invention relates to methods and apparatus for exercising a person's quadriceps muscles in isolated, closed chain fashion.

BACKGROUND OF THE INVENTION

The quadriceps muscles constitute one of the human body's major muscle groups, and these muscles are primarily responsible for moving a person's legs from a bent knee position to a straight leg position. Exercise machines have been built for the specific purpose of resisting this particular motion and thereby strengthening and/or toning the quadriceps muscles.

A conventional quadriceps exercise machine, known in the fitness industry as a leg extension machine, is shown in FIGS. 6–7. The prior art leg extension machine 90 generally includes a frame 91, a seat 92 rigidly mounted on the frame 91, a pivot arm 93 pivotally mounted on the frame 91, and a weight stack resistance device 97 operatively connected to the pivot arm 93. The resistance device 97 includes a variable amount of weight 98 that is connected to the pivot arm 93 by means of a cable 99. The components are preferably arranged so that a user's knee is axially aligned with the pivot axis of the pivot arm 93, and a pad 94 is mounted on an opposite, distal end of the pivot arm 93 to bear against the user's shin. Counter-clockwise rotation of the pad 94, caused by straightening of the user's leg at the knee (but not the hip), is resisted by gravity acting upon the weight 98.

The leg extension machine 90 has been a staple item in fitness clubs for decades. Typically, it is provided as part of a circuit of a dozen or so machines, each of which is dedicated to a single exercise and/or a particular muscle group. In this regard, the leg extension machine 90 is provided for isolated exercise of a person's quadriceps muscles. Generally speaking, the theory behind these circuits is that each machine allows a person to focus on a specific muscle group or exercise movement, and several people can use alternative machines in parallel. In another familiar arrangement suitable for circuit training, a similar leg extension arrangement is supported by a relatively larger frame that also supports several other types of exercise mechanisms (sometimes referred to as a universal gym).

Unfortunately, recent medical opinions are suggesting that conventional leg extension machines (and mechanisms) may cause pain and/or damage to a person's knees. One possible explanation is that the conventional leg extension exercise involves an "open chain" arrangement, wherein the person's lower leg is loaded in cantilevered fashion. Generally speaking, this sort of exercise tends to impose significant shearing force on a person's joint (in this case, the knee). On the other hand, a "closed chain" exercise involves stabilization of the distal ends of any limbs being exercised, thereby contributing to joint stability and coordinated interaction of the associated body components.

One type of conventional "closed chain" exercise machine, known in the fitness industry as a leg press machine, is shown in FIGS. 8–9. Like the leg extension machine 90, the leg press machine 80 has also been a staple item in fitness clubs for decades, and is similarly provided as part of a circuit of machines and on universal gym units.

The prior art leg press machine 80 generally includes a frame 81, a seat 82 slidably mounted on the frame 81, a foot platform 83 mounted on the frame 81 in front of the seat 82, and a weight stack resistance device 87 operatively connected to the seat 82. The resistance device 87 includes a variable amount of weight 88 that is connected to the seat 82 by means of a cable 89. Movement of the seat 82 away from the foot platform 83, caused by extension of the user's legs at both the hip joints and the knee joints, is resisted by gravity acting upon the weight 88. Another common type of leg press machine (not shown) has a fixed seat and a pivoting foot support. Movement of the pedals away from the seat is similarly caused by extension of the user's leg at both the knees and the hips.

Although conventional leg press machines facilitate closed chain exercise of a person's quadriceps muscles, a significant amount of the user exerted force is generated by a person's gluteus muscles (due to extension of the user's legs at the hips, as well as the knees). As a result, conventional leg press machines are ineffective for isolated exercise of a person's quadriceps muscles. In other words, a need exists for an exercise apparatus that facilitates isolated, closed chain exercise of a person's quadriceps muscles.

SUMMARY OF THE INVENTION

The present invention provides methods and apparatus for exercising a person's quadriceps muscles in isolated, closed chain fashion. The present invention may be implemented in various ways and/or described with reference to various embodiments. A preferred embodiment includes a frame designed to rest on a floor surface; a body support that is mounted on the frame and includes at least a back rest; and a foot platform that is mounted on the frame in front of the body support. The body support and the foot platform are configured and arranged to support a person in a rest position with his back against the back rest, his thighs extending generally perpendicular to his torso, his legs bent at the knees, and his feet flat against the foot platform. At least one of the body support and the foot platform is pivotally mounted on the frame in a manner that maintains an orthogonal angle between the person's thighs and torso as the person straightens his legs at the knees while pressing his feet against the foot platform. Also, a resistance device resists straightening of the person's legs at the knees by resisting relative rotation between the back rest and the foot platform. As a result, the preferred embodiment isolates the user's quadriceps muscles in a closed chain arrangement. Many features and/or advantages of the present invention will become apparent from the more detailed description that follows.

BRIEF DESCRIPTION OF THE FIGURE OF THE DRAWING

With reference to the Figures of the Drawing, wherein like numerals designate like parts and assemblies throughout the several views, FIG. 1 is a perspective view of a preferred embodiment exercise machine constructed according to the principles of the present invention;

Figure 1:
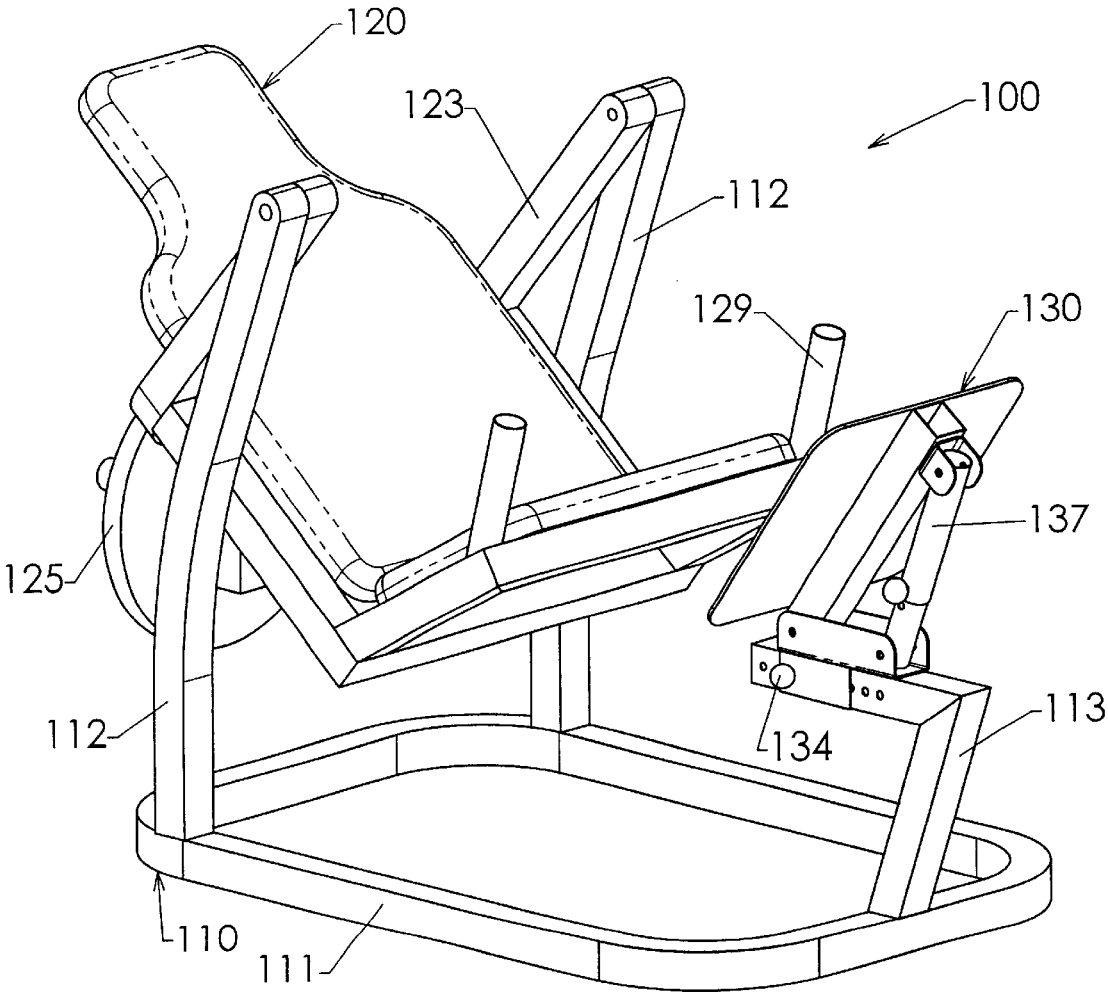
Figure 4A:
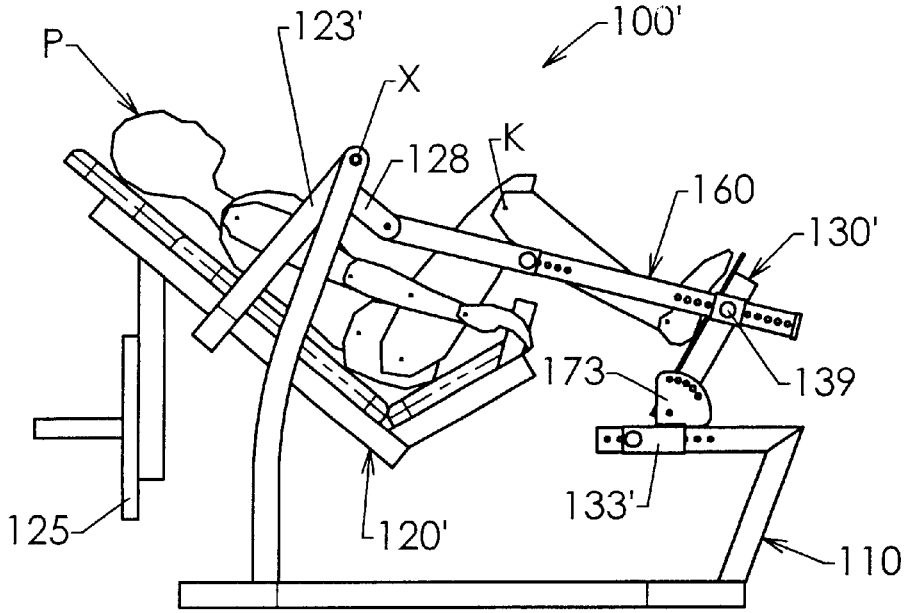
Figure 4B:
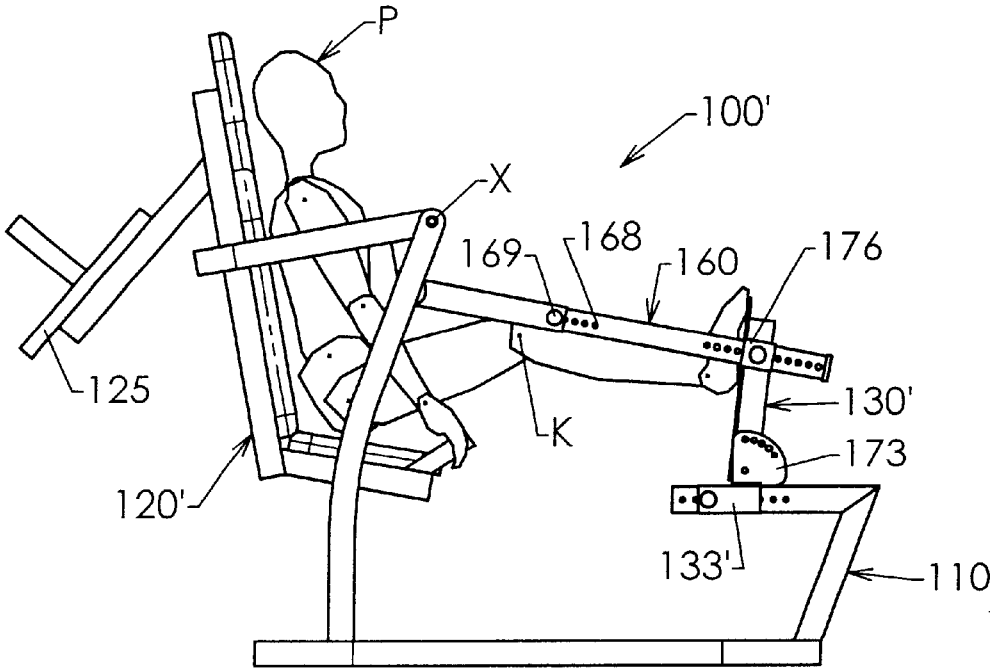
Figure 5A:
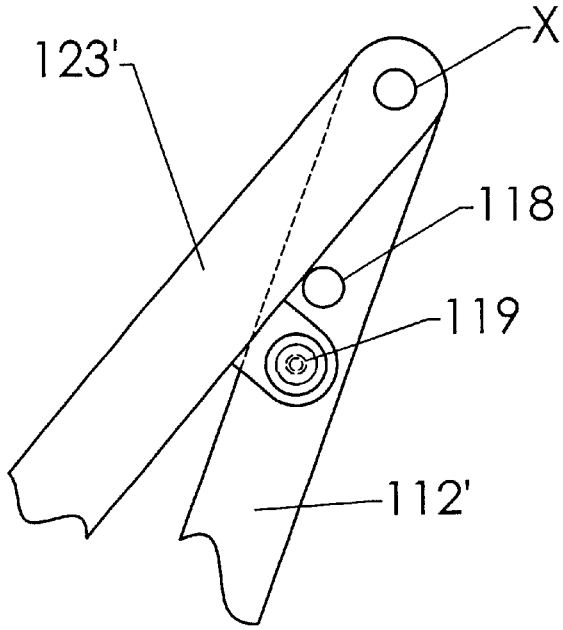
Figure 5B:
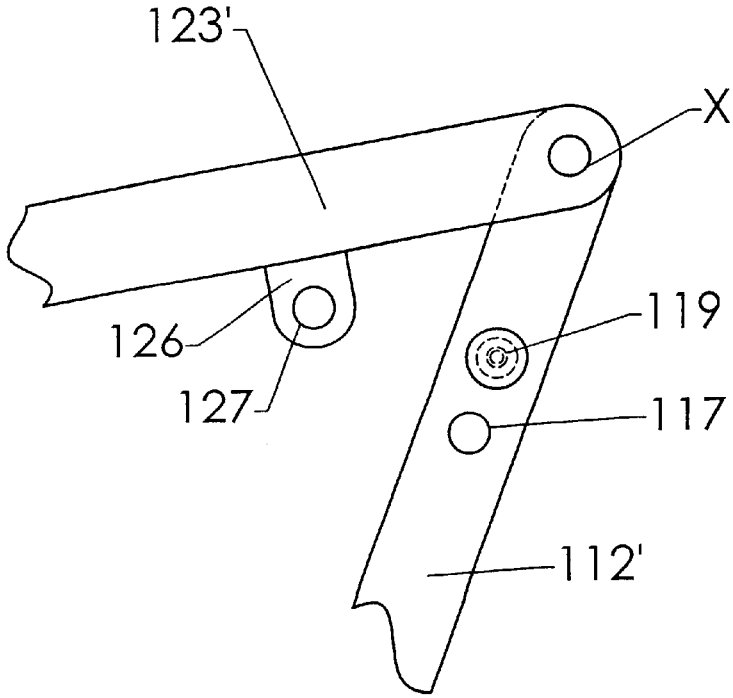
Figure 6:
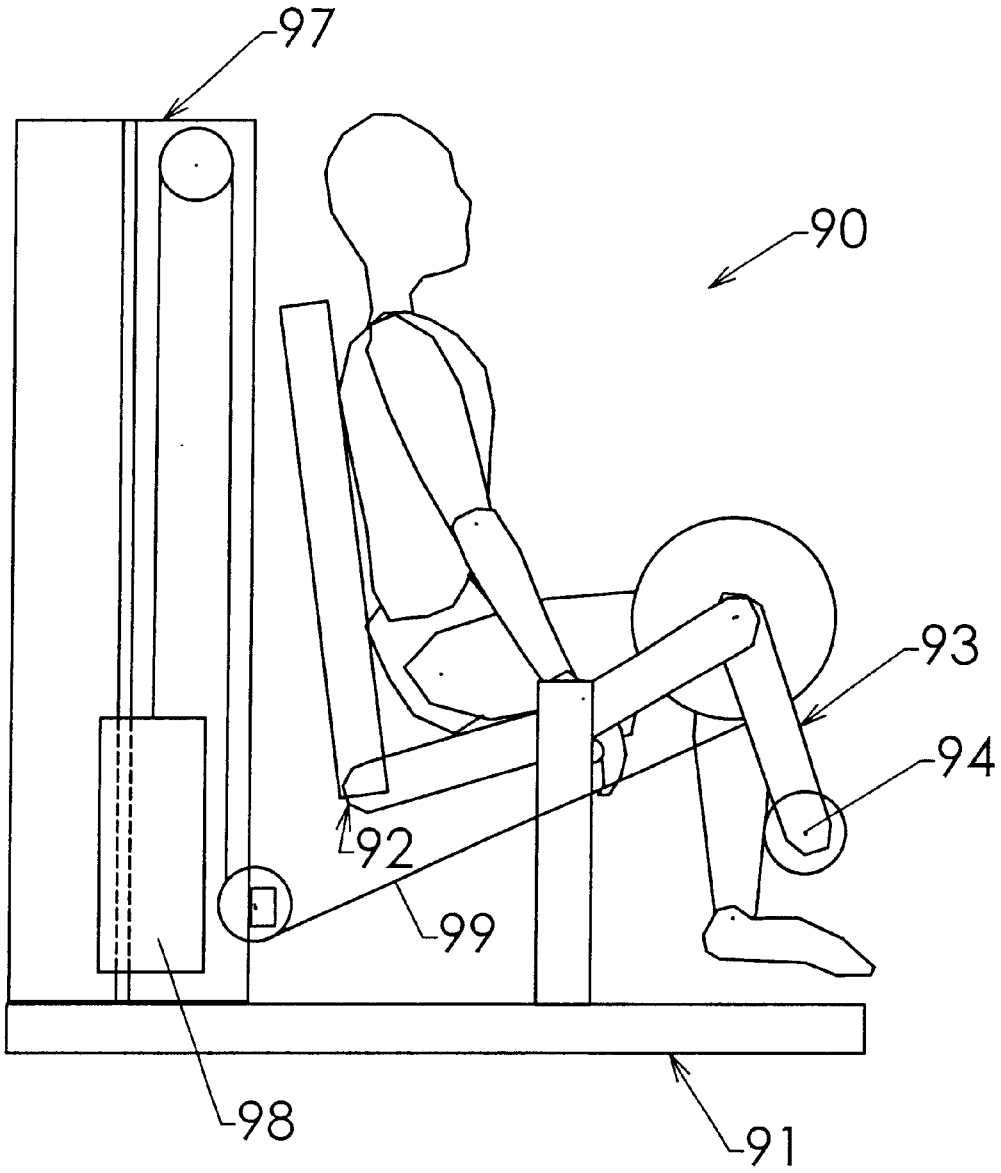
Fig. 6 (prior art)
Figure 7:
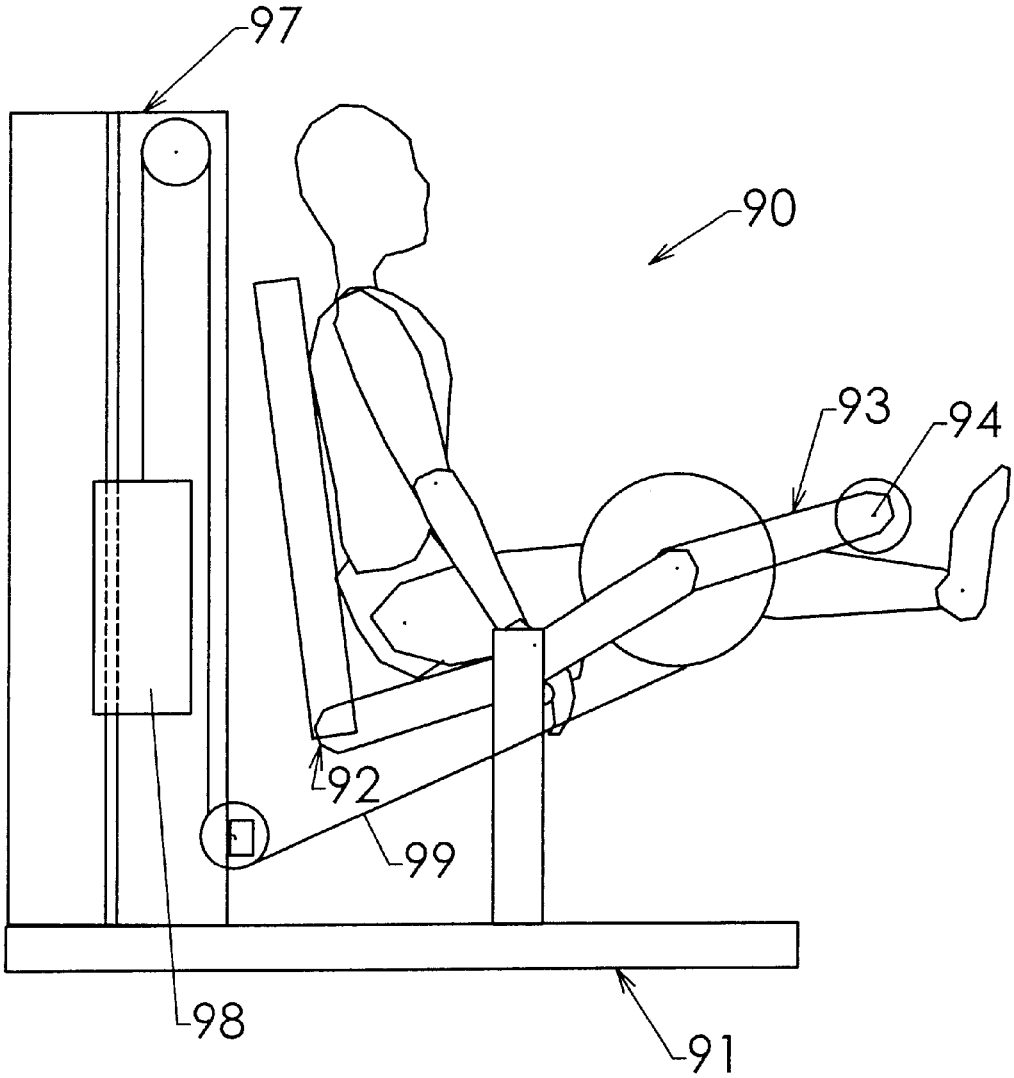
Fig. 7 (prior art)
Figure 8:
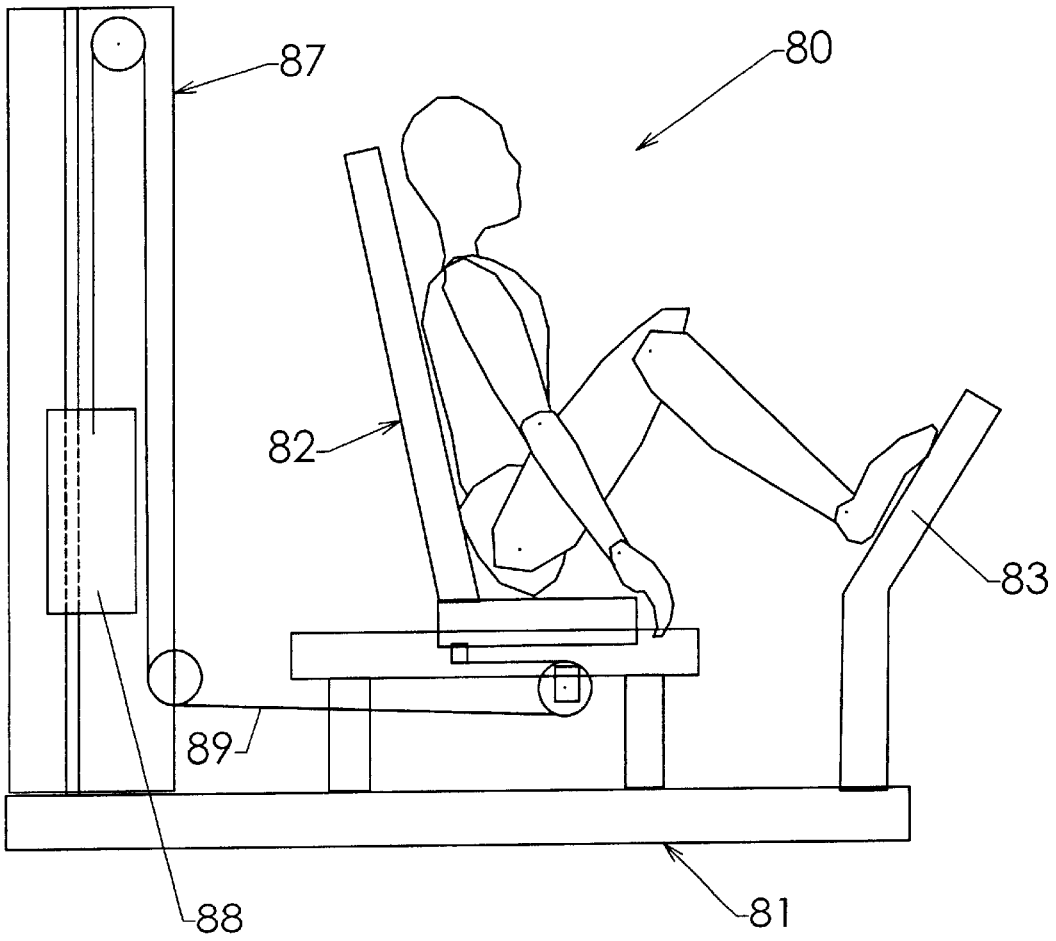
Fig. 8 (prior art)
Figure 9:
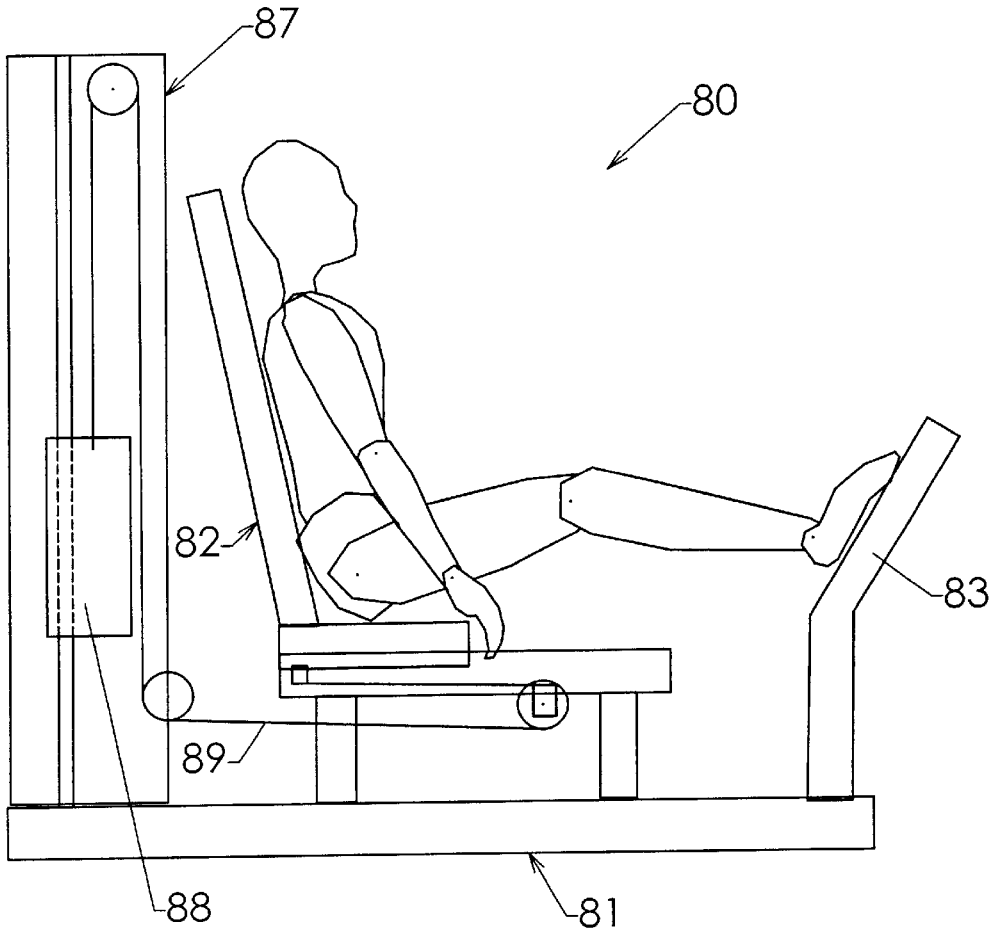
Fig. 9 (prior art)
Figure 10:
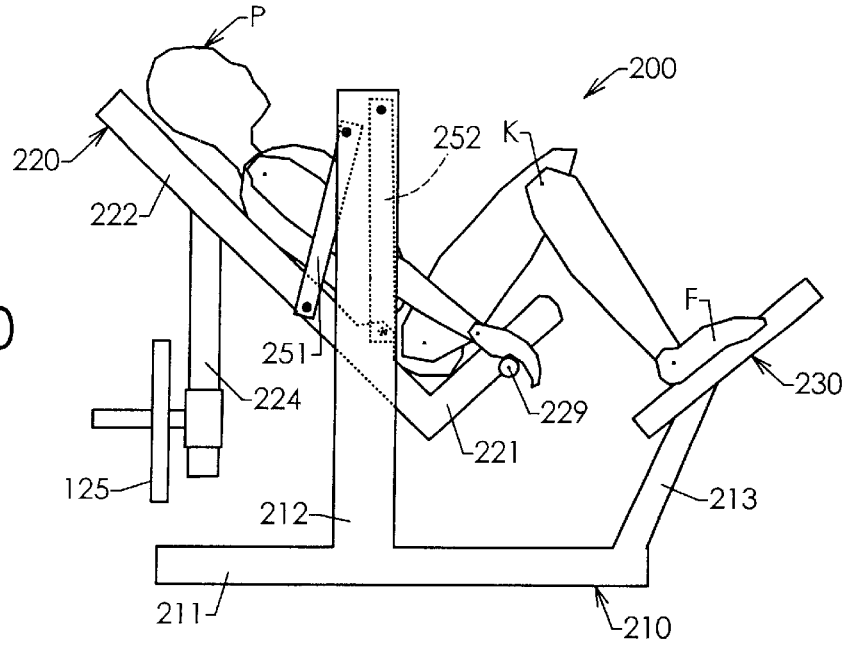
Figure 11:
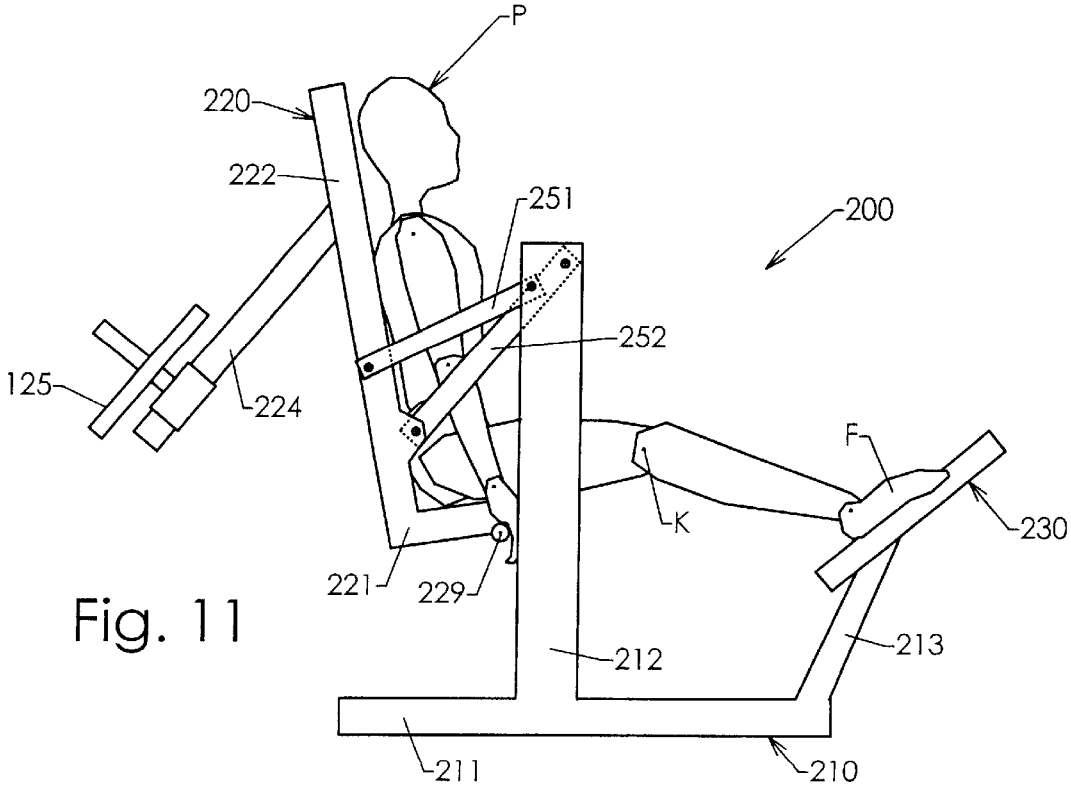
Figure 12:
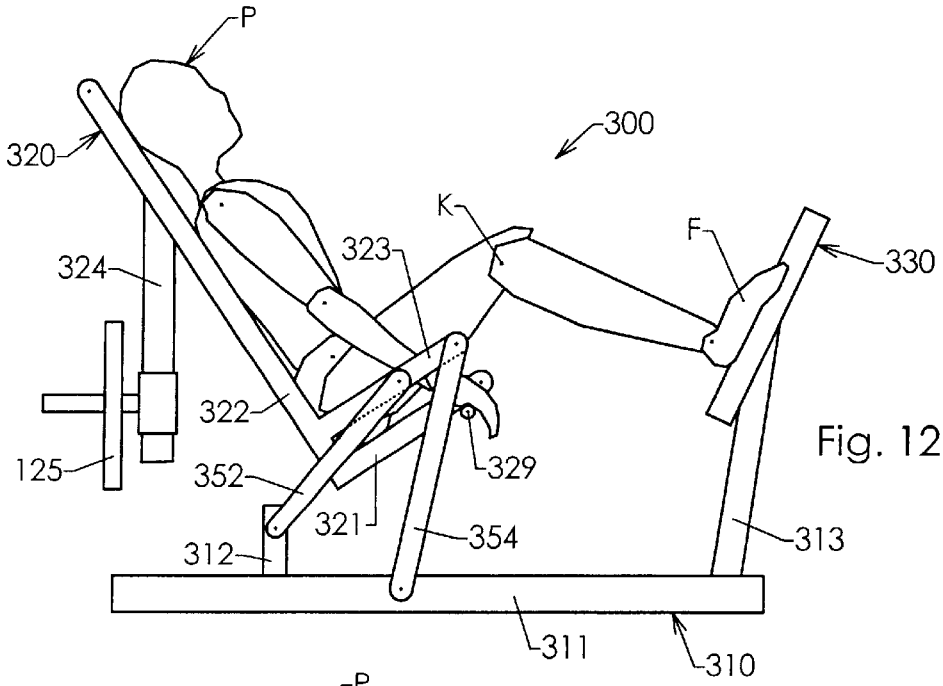
Figure 13:
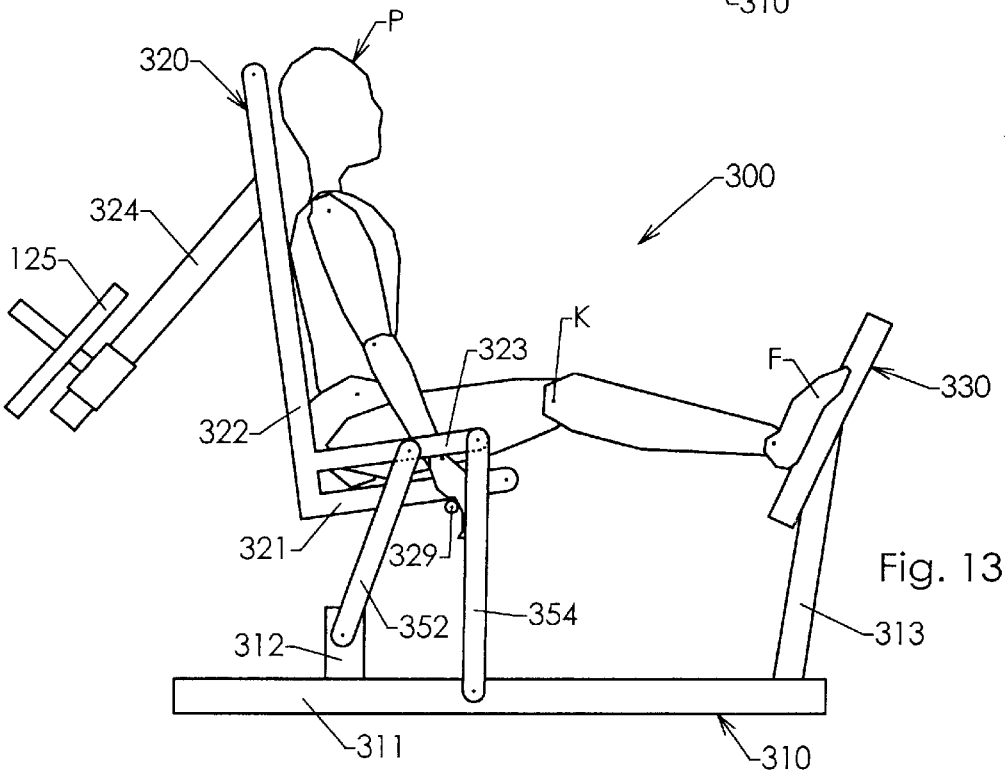
Figure 14:
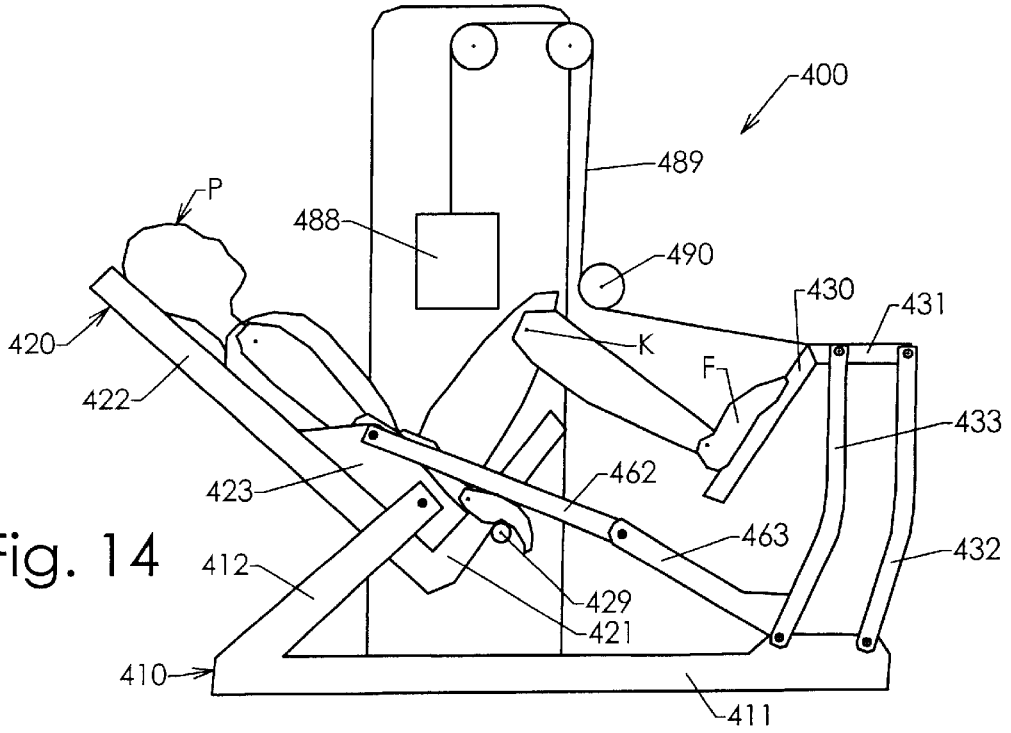
Figure 15:
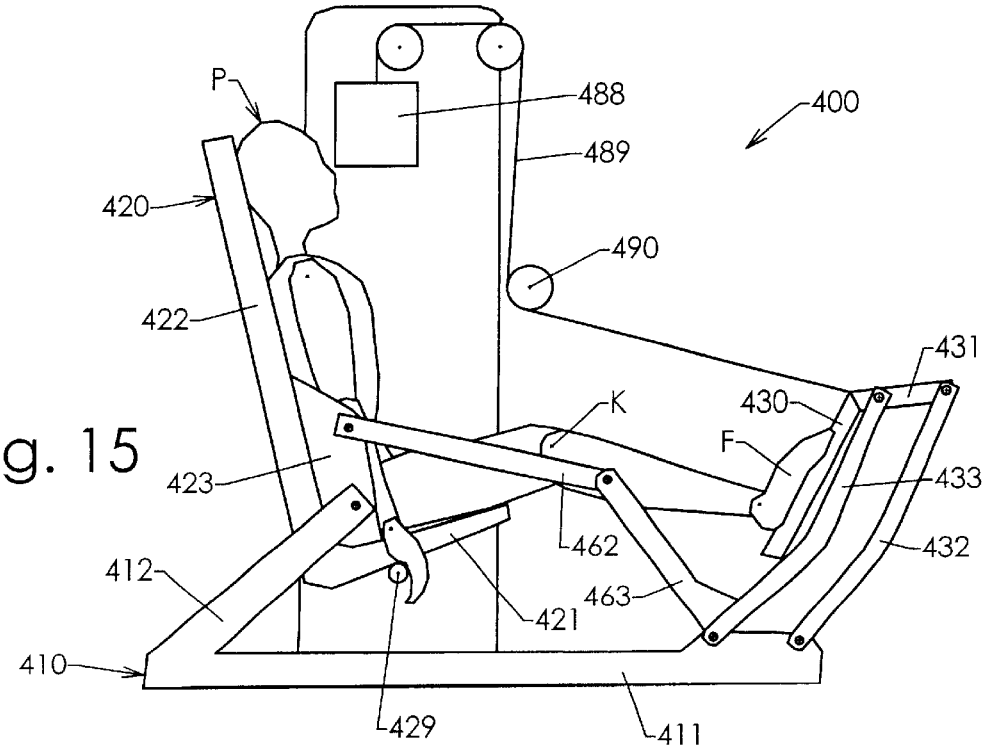
Figure 16:
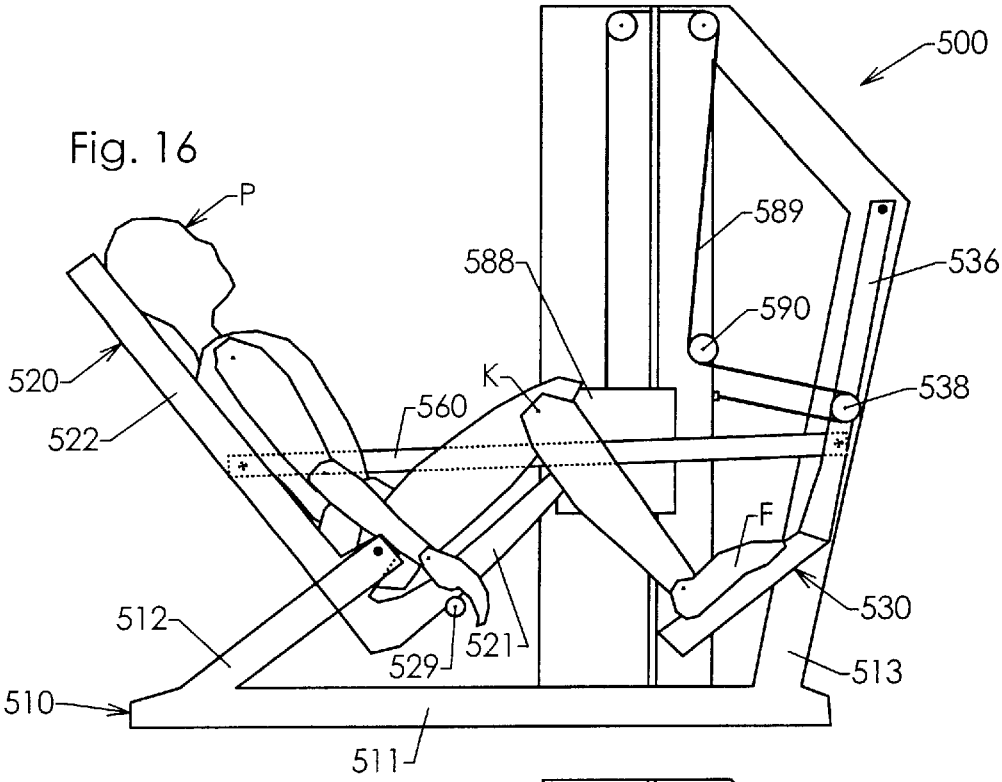
Figure 17:
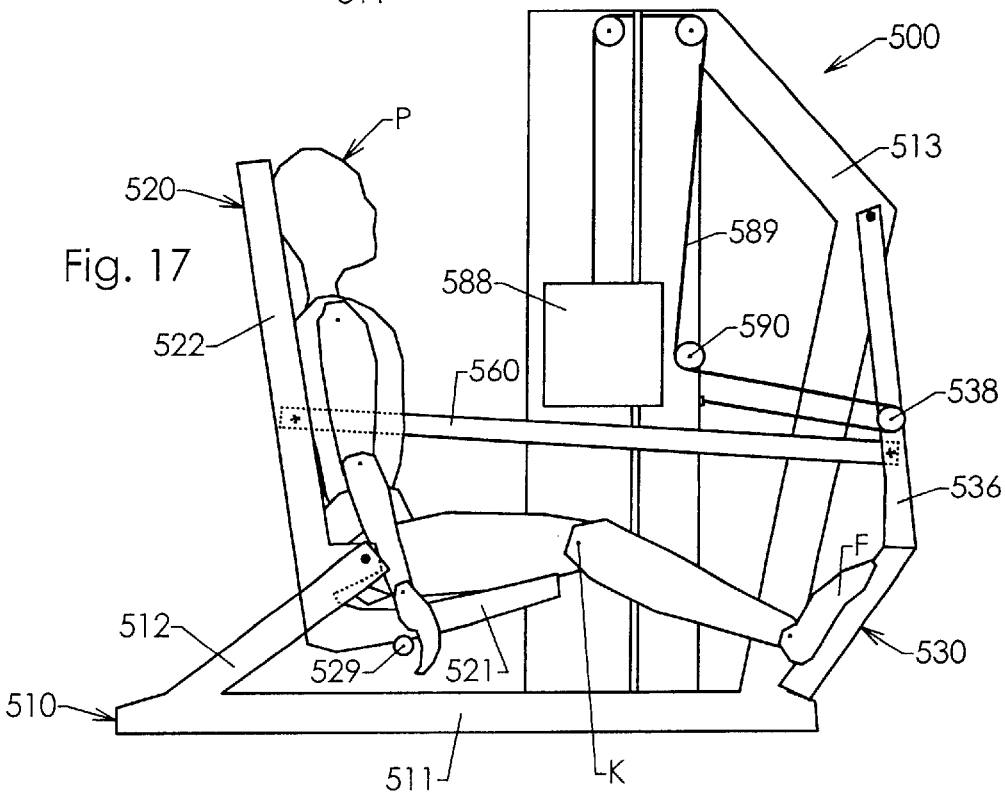
Figure 18:
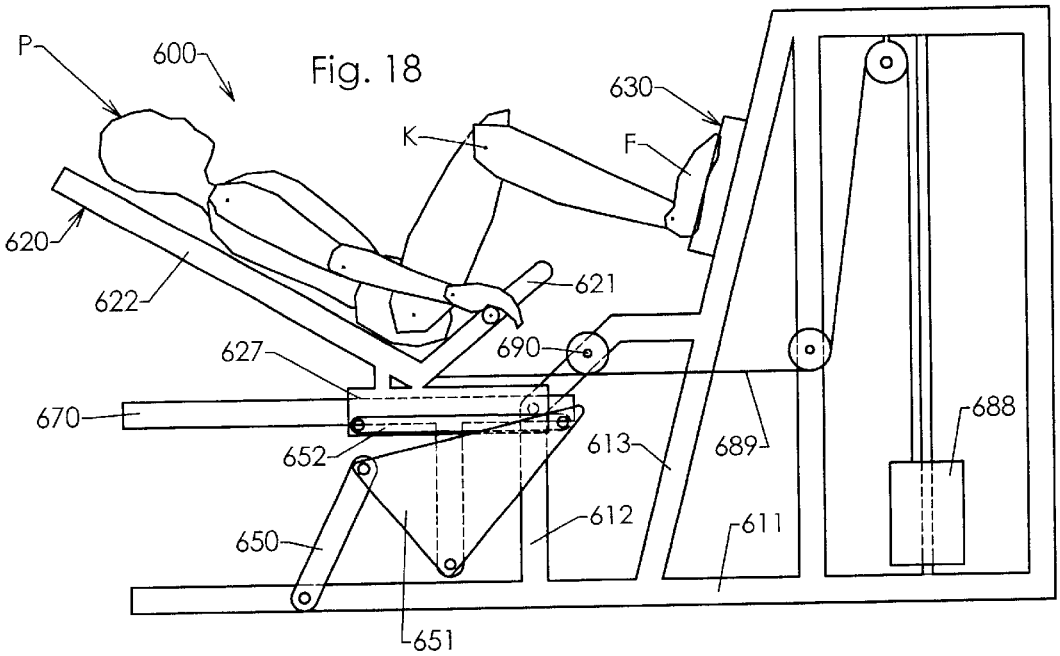
Figure 19:
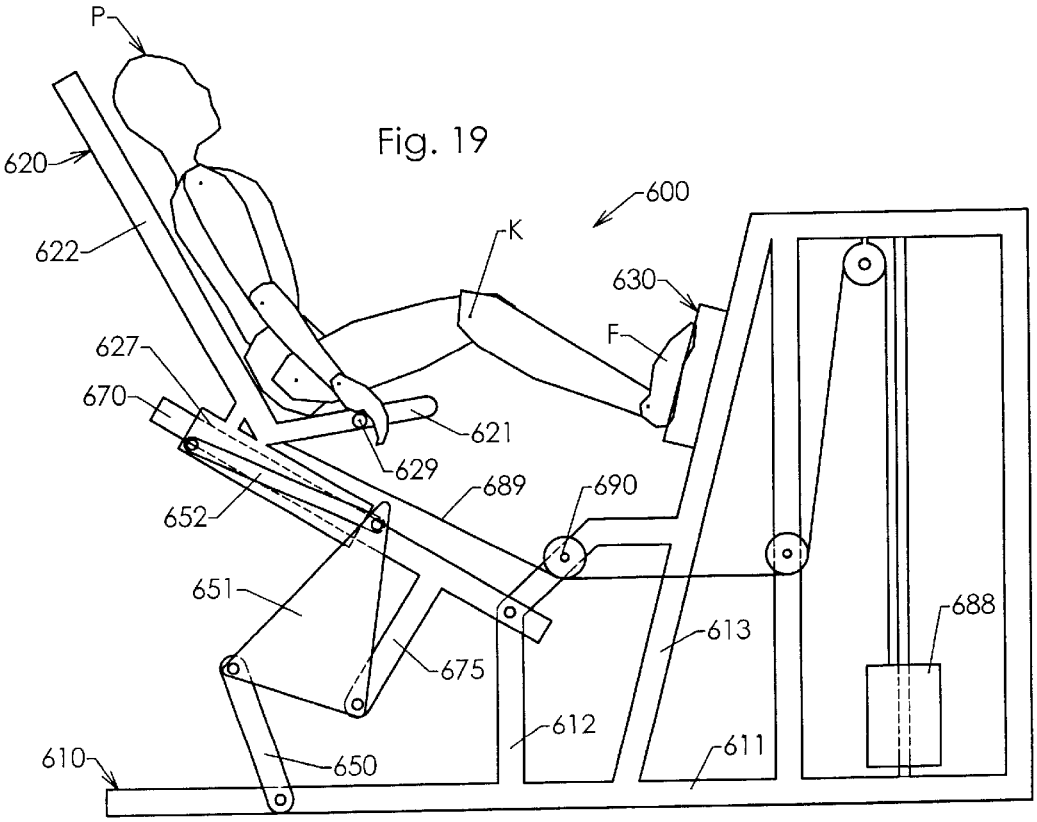
Figure 20:
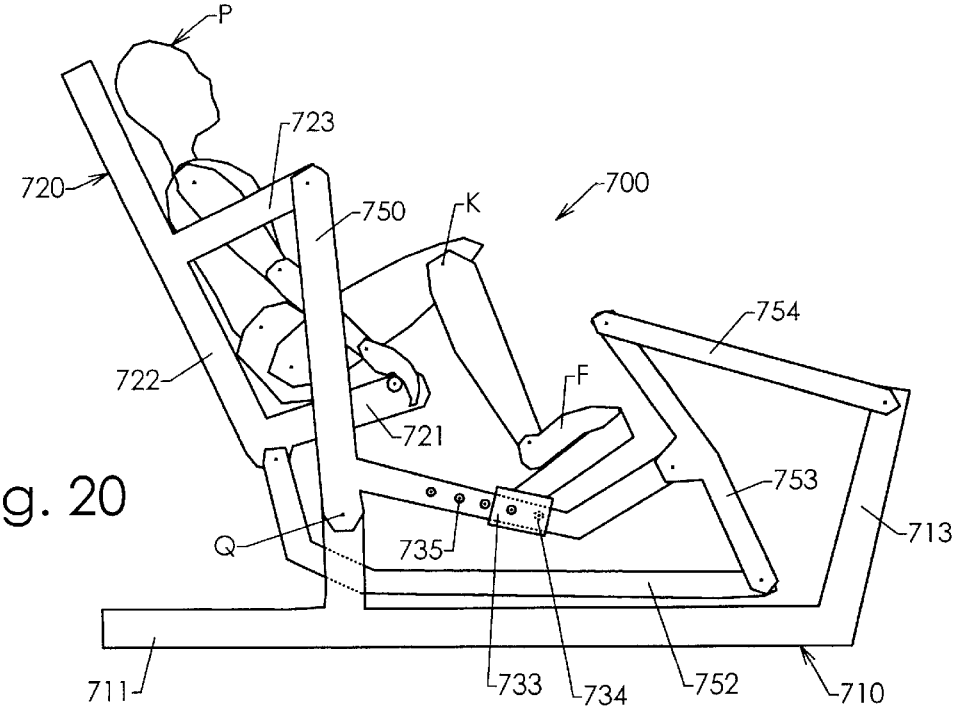
Figure 21:
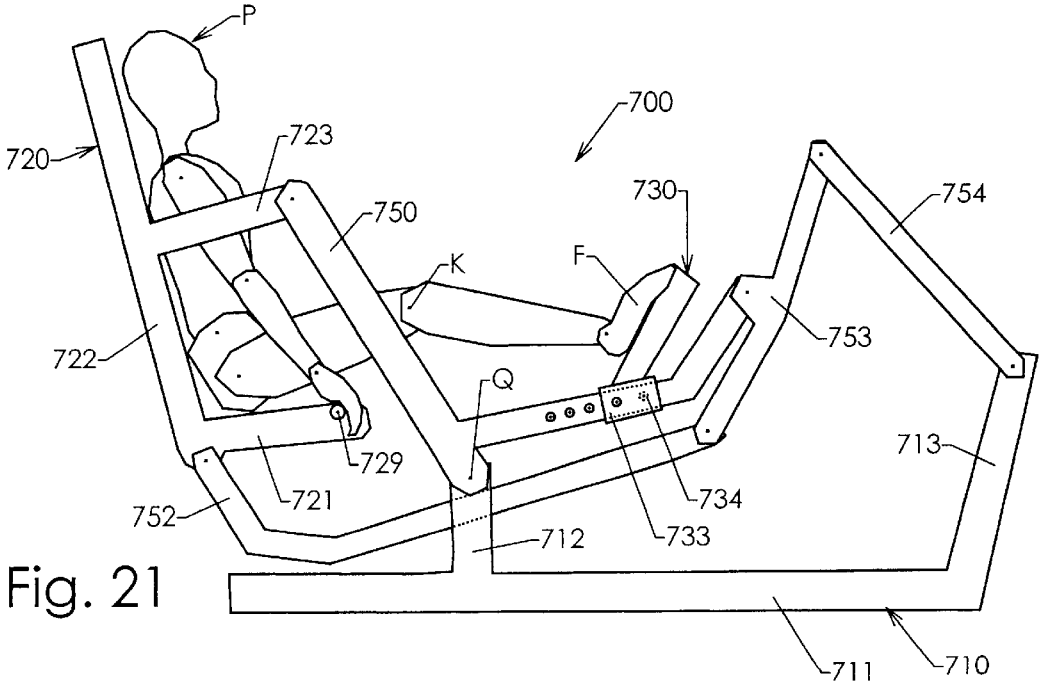

FIG. 4*a* is a side view of an alternative embodiment exercise machine constructed according to the principles of the present invention, showing a user in a start position;

FIG. 4*b* is a side view of the exercise machine of FIG. 4*a*, showing the user's legs in an extended position;

FIG. 5*a* is an enlarged and fragmented side view of an optional arrangement suitable for use on the exercise machine of FIG. 1 for purposes of latching the body support relative to the frame and/or limiting forward pivoting of the body support relative to the frame, showing the body support latched to the frame;

FIG. 5*b* is an enlarged and fragmented side view of the optional arrangement of FIG. 5*a*, showing a limit imposed on forward pivoting of the body support;

FIG. 6 is a side view of a prior art leg extension machine, showing a user in a start position;

FIG. 7 is a side view of the prior art leg extension machine of FIG. 6, showing the user's legs in an extended position;

FIG. 8 is a side view of a prior art leg press machine, showing a user shown in a start position;

FIG. 9 is a side view of the prior art leg press machine of FIG. 8, showing the user's legs in an extended position;

FIG. 10 is a side view of another exercise machine constructed according to the principles of the present invention, showing a user in a start position;

FIG. 11 is a side view of the exercise machine of FIG. 10, showing the user's legs in an extended position;

FIG. 12 is a side view of another exercise machine constructed according to the principles of the present invention, showing a user in a start position;

FIG. 13 is a side view of the exercise machine of FIG. 12, showing the user's legs in an extended position;

FIG. 14 is a side view of another exercise machine constructed according to the principles of the present invention, showing a user in a start position;

FIG. 15 is a side view of the exercise machine of FIG. 14, showing the user's legs in an extended position;

FIG. 16 is a side view of another exercise machine constructed according to the principles of the present invention, showing a user in a start position;

FIG. 17 is a side view of the exercise machine of FIG. 16, showing the user's legs in an extended position;

FIG. 18 is a side view of yet another exercise machine constructed according to the principles of the present invention, showing a user in a start position;

FIG. 19 is a side view of the exercise machine of FIG. 18, showing the user's legs in an extended position;

FIG. 20 is a side view of still another exercise machine constructed according to the principles of the present invention, showing a user in a start position; and FIG. 21 is a side view of the exercise machine of FIG. 20, showing the user's legs in an extended position.

DETAILED DESCRIPTION OF A PREFERRED EMBODIMENT

Figure 2:
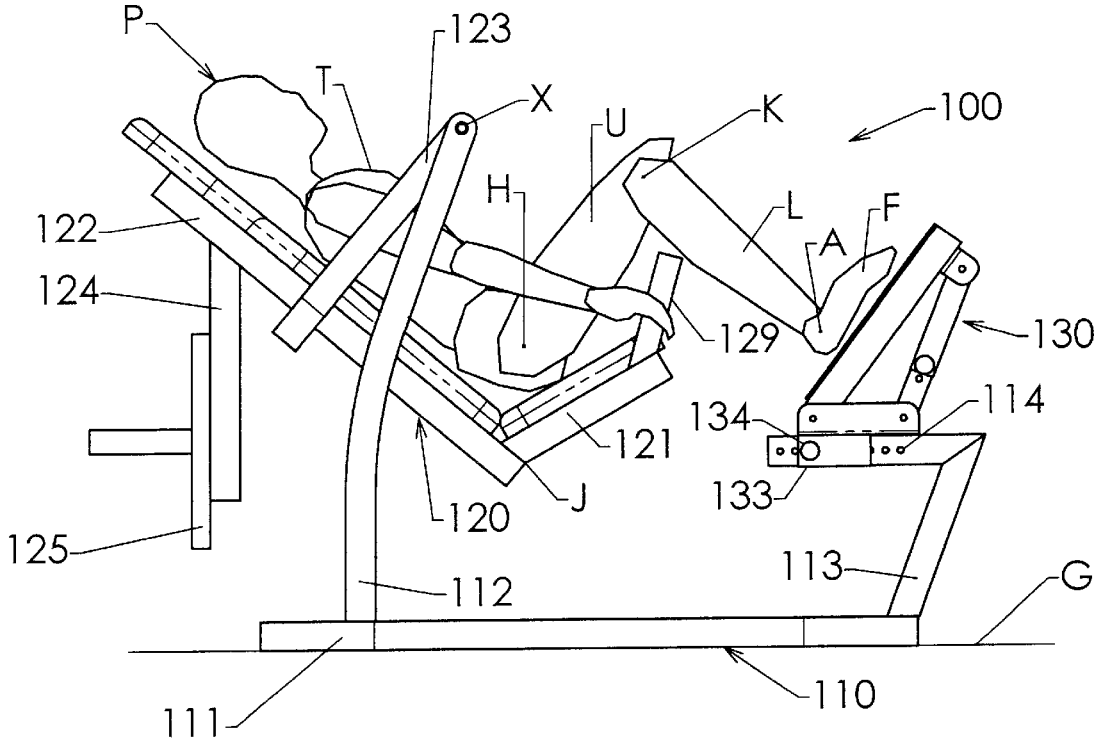
FIG. 2 is a side view of the exercise machine of FIG. 1, showing a user in a start position.
Figure 3:
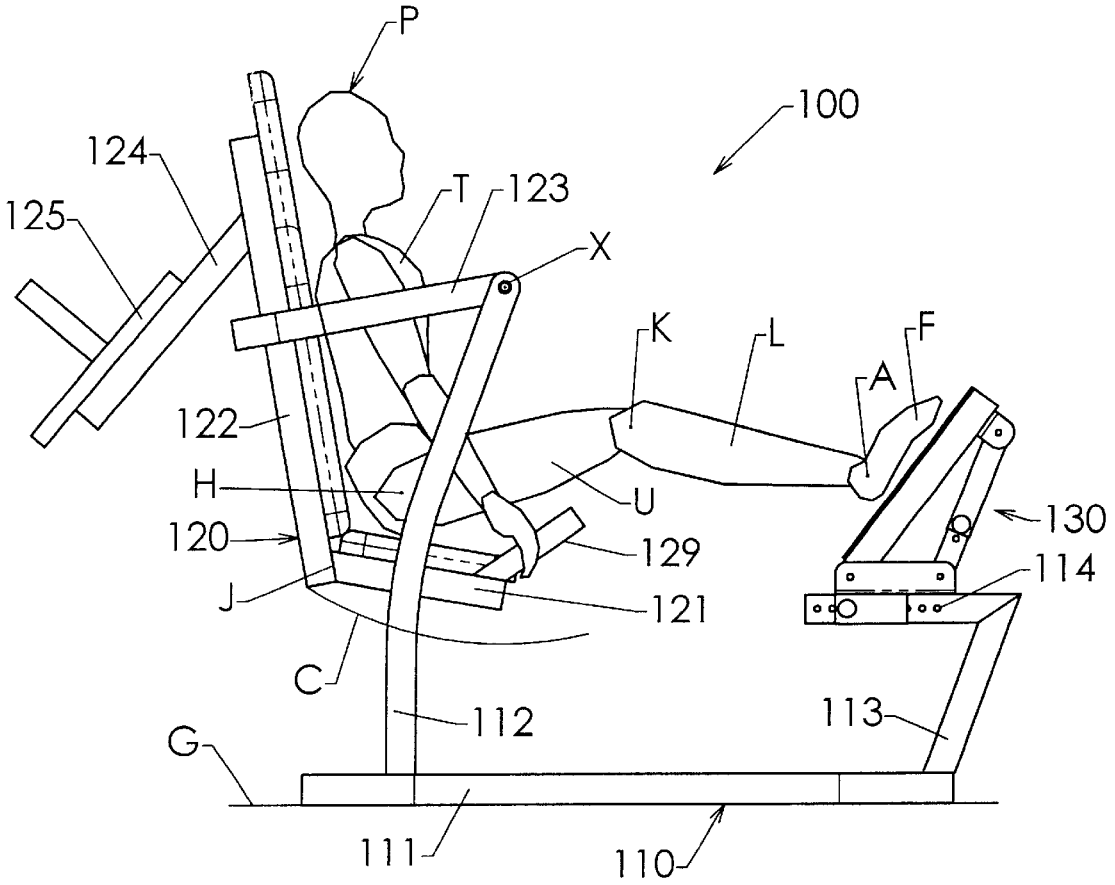
FIG. 3 is a side view of the exercise machine of FIG. 1, showing the user's legs in an extended position.

A first exercise apparatus constructed according to the principles of the present invention is designated as 100 in FIGS. 1–3. The exercise apparatus 100 generally includes a frame 110, a body support 120 mounted on the frame 110, and a foot platform 130 mounted on the frame 110. The frame 110 includes a base 111 designed to rest on the ground or floor surface G. The base 111 has a front end, a rear end, and opposite sides. Rubber pads or feet may be secured to the bottom of the base 111 to encourage the apparatus 100 to remain in a stationary position relative to the floor surface G and/or reduce the likelihood of damage to the floor surface G. The frame 110 also includes left and right stanchions 112 that extend vertically upward from opposite sides of the base 111 proximate the rear end, and a forward stanchion 113 that extends upward from the forward end of the base 111.

The body support 120 preferably includes both a seat 121 and a back rest 122 that are rigidly secured to one another (in the region designated as J), and that define an angle of approximately one hundred and ten degrees therebetween. In this regard, the seat 121 and the back rest 122 may be described as approximately perpendicular to one another, with the understanding that approximately is being used in this context to allow for a variance of twenty degrees more or less. Left and right pivot arms 123, which may be opposite distal ends of a single U-shaped member, are rigidly secured to the back rest 122 and extend forward from opposite sides thereof. Forward distal ends of the pivot arms 123 are pivotally connected to upper distal ends of respective stanchions 112, thereby defining a common pivot axis X. In other words, the body support 120 is disposed between the stanchions 112 and pivotally mounted on the frame 110 at the pivot axis X. Left and right handlebars 129, which may be opposite ends of a single U-shaped member, are rigidly secured to the body support 120, within reach of a person P resting on the body support 120.

A bracket 124 is rigidly secured to the rear side of the back rest 122 and extends downward and rearward from the back rest 122. One or more weight plates 125 may be selectively mounted on the bracket 124 by means known in the art. In this regard, those skilled in the art will recognize that the depicted embodiment 100 may be described as a "plate loaded" type of exercise machine. Those skilled in the art will also recognize that the present invention may be implemented with other types of known resistance means. For example, in place of the bracket 124 and weight plates 125, a cable could extend from the back rest 122 (proximate the fixed end of the pivot arms 123), downward and about a pulley, and then upward and about a pulley on a weight stack unit (similar to the embodiments shown in FIGS. 14–19, for example). Other suitable resistance means may utilize frictional resistance, fluid resistance, resilient force resistance, and/or electromechanical resistance, all of which are well known in the art and may be adapted for use with the subject invention.

The foot platform 130 may be described as a planar member or plate (or two adjacent co-planar plates) having a lower end connected to the stanchion 113, and an upper distal end. The foot platform 130 is preferably adjustable fore and aft relative to the frame 110 (and the body support 120). For example, on the embodiment 100, the stanchion 113 terminates in a horizontal distal portion that is provided with laterally extending holes 114. A sleeve 133 is rigidly mounted on the lower end of the foot platform 130, and is slidably mounted on the horizontal distal portion of the stanchion 113. A spring-biased "pop pin" 134 or other suitable fastener is inserted through a hole in the sleeve 133 and any of several holes 114 in the stanchion 113 to secure the foot platform 130 in any of several available locations.

The orientation of the foot platform 130 relative to the frame 110 is also preferably adjustable. For example, a bracket 135 is shown mounted on sleeve 133, and a lower end of the foot platform 130 is shown pivotally mounted on the bracket 135 for selective pivoting about pivot axis Z. A trunnion 136 is rigidly mounted on the upper end of the foot supporting portion of the foot platform 130, on a side opposite the person's feet F. An adjustable length, telescoping member 137 is pivotally interconnected between the bracket 135 and the trunnion 136. A spring-biased "pop pin"

139 or other suitable fastener is inserted through a hole in the cylindrical portion of the telescoping member 137 and through any of several holes 138 in the rod portion of the telescoping member 137 to secure the foot platform 130 in any of several possible orientations relative to the frame 110. Those skilled in the art will recognize that other adjustment arrangements (e.g., a hole in the foot platform bracket that aligns with any of several circumferentially spaced holes provided in a bracket at a common radius from the pivot axis Z), and/or other actuation arrangements (e.g., a lead screw or linear actuator) may be used to adjust the orientation and/or location of the foot platform.

Another option is to provide a foot platform that pivots during exercise activity. Such a platform may be configured and arranged so that the associated foot engaging surface faces toward the associated pivot axis, thereby encouraging a self-centering effect. Yet another option is to provide a linkage between a pivotal foot platform and a pivotal body support in a manner that favorably links pivoting of same. In either case, a pivotal foot platform may be desired to maintain a comfortable angle between the person's feet and lower legs and/or to accommodate at least some of the lower leg motion associated with the exercise activity.

A pivotal foot platform is shown in FIGS. 4*a*–4*b*, and some other possible arrangements are described further below with reference to FIGS. 14–17. As suggested by the common reference numerals, the apparatus 100' shown in FIGS. 4*a*–4*b* is similar in many respects to the apparatus 100. In fact, the only significant difference is that a drawbar link 160 has been pivotally interconnected between one of the pivot arms 123' (via extension 128) and a corresponding side of the foot platform 130'. As a result, the apparatus 100' may be operated in more than one mode. In a first mode of operation (not shown), the orientation of the foot platform 130' is fixed, and the connector link 160 simply slides relative to a sleeve 176 that is pivotally mounted on the foot platform 130', and the apparatus 100' operates in the same manner as the apparatus 100. As on the apparatus 100, provision is made for adjusting the location and/or orientation of the foot platform 130' relative to the frame 110. In this case, a bracket 173 is rigidly mounted on the sleeve 133', and the foot platform 130' is pivotally mounted on the bracket 173. The bracket 173 is provided with several circumferentially spaced holes disposed at a common radius from the pivot axis of the foot platform 130', and a fastener is inserted through one of these holes and an alignable hole in the foot platform 130' to secure the foot platform 130' in a particular orientation relative to the frame 110.

In a second mode of operation (shown in FIGS. 4*a*–4*b*), the fastener associated with the orientation of the foot platform 130' is removed, and the drawbar link 160 is pivotally coupled to the sleeve 176 (preferably by means of the same, dual purpose fastener 139). As a result, the body support 120' and the foot platform 130' are constrained to pivot in opposite directions. The drawbar link 160 is preferably provided in the form of a selectively telescoping member that is adjustable in length to accommodate people of various sizes and/or various start positions. In this regard, a similar fastener 169 inserts through a hole in a cylinder portion of the drawbar link 160 and any of several holes 168 in a rod portion of the drawbar link 160 to selectively establish the length of the drawbar link 160.

With reference back to FIGS. 1–3, the apparatus 100 is shown and described with reference to the figure of a person P, who is representative of a well-proportioned, six foot tall man. The person P and the machine 100 are drawn to scale relative to one another to facilitate understanding of the machine's dimensions and the geometric relationships between man P and machine 100. In order to accommodate a wide range of user needs and/or sizes, the machine 100 may be adjusted as discussed above and/or in additional ways (e.g., changing the pivot radius of the body support).

FIG. 2 shows the person P occupying a start or rest position on the body support 120, with the back rest 122 facing forward and away from the floor surface G at an angle of approximately fifty degrees from horizontal, and the foot platform 130 facing rearward and away from the floor surface G at an angle of approximately forty degrees from horizontal. In this regard, the back rest 122 may be described as approximately perpendicular to the foot platform 130, where approximately is intended to allow for a variance of twenty degrees more or less, and/or as generally perpendicular to the foot platform 130, where generally is intended to allow for a variance of forty degrees more or less (meaning closer to perpendicular than to parallel by at least five degrees).

A stop may be mounted on the frame 110 to prevent forward pivoting of the body support 120 beyond the position shown in FIG. 2, and/or a latch may be mounted on the frame 110 to selectively latch the body support 120 in the position shown in FIG. 2. Relatively simple examples of each type of arrangement are shown in FIGS. 5*a*–5*b*, with the understanding that other suitable arrangements may be used in the alternative. As shown in FIG. 5*a*, the latching arrangement is implemented by inserting a bolt 119 or other suitable fastener through a hole 127 in a bracket 126 on the modified right pivot arm 123' and through an aligned hole 117 in the modified right stanchion 112'. As shown in FIG. 5*b*, the stopping arrangement is implemented by inserting the bolt 119 through a relatively higher hole 118 in the modified stanchion 112' and into the path of the right pivot arm 123' at a point in front of the right pivot arm 123'.

With reference back to FIG. 2, the person P is resting on the body support 120 and grasping the handlebars 129 in his respective hands. The person's torso T and head are aligned with and supported by the back rest 122, and his upper legs U are extending approximately perpendicular to his torso T. The person's hips H are about eighteen inches from the pivot axis X, but this particular embodiment 100 is effective with a range of radial distances between X and H. The person's legs are bent at the knees K so that his lower legs L and his upper legs U cooperate to define an angle of approximately ninety degrees therebetween. The person's feet F are disposed forward of the seat 121 and the soles of his feet F are pressed against the foot platform 130 (thereby establishing a closed chain). The person's ankles A are relaxed, and the person's feet F are extending approximately perpendicular to the person's lower legs L.

For ease of reference, operational characteristics of the apparatus 100 may be described with reference to line segments extending from the person's hip joints H to his knee joints K (HK), and from the person's knee joints K to his ankle joints A (KA), and from the person's ankle joints to his hip joints (AH). The HK distance is about eighteen inches, and the KA distance is about nineteen and one-half inches. The AH distance is approximately twenty-four inches in FIG. 2, and is approximately thirty-six and one-half inches in FIG. 3.

FIG. 3 shows the person P with his legs relatively straight at the knees K, and the body support 120 having pivoted rearward about the pivot axis X. In this extended position, the person's upper legs U and lower legs L cooperate to define an angle of approximately one hundred and seventy degrees therebetween, which corresponds to an eighty degree change in the angle defined by the person's knees K. In order to reach the position shown in FIG. 3, the body support 120 has pivoted through an angle of approximately forty degrees, which is one-half the change in angle experienced by the person's knees K. The length of the arcuate path traveled by the person's hips H is equal to (2*Π*18) *(40/360) or about twelve and one-half inches (the difference between AH in FIG. 3 and AH in FIG. 2).

The transition between the positions shown in FIGS. 2 and 3 may also be described in terms of both the body support 120 and the person's upper legs U pivoting forty degrees clockwise relative to the frame 110, and the person's lower legs L pivoting forty degrees counter-clockwise relative to the frame 110. On the apparatus 100' shown in FIGS. 4*a*–4*b*, the body support 120' pivots to accommodate the change in distance between the user's hips and ankles, and the foot platform 130' pivots to maintain an orthogonal angle between the user's feet and lower legs. Throughout the range of exercise motion on either machine 100 or 100', the person's upper legs U remain orthogonal to the back rest 122 (as on the prior art leg extension machine 90 shown in FIGS. 6–7). As a result, the force contribution from the person's gluteus muscles is essentially minimized, and the force contribution from the person's quadriceps muscles is essentially maximized. Also, the exercise motion involves a chain of body parts that is compressed between the back rest 122 and the foot platform 130 (as on the prior art leg press machine 80 shown in FIGS. 8–9). In other words, the apparatus 100 facilitates isolated, closed chain exercise of the person's quadriceps muscles.

Another embodiment of the present invention is designated as 200 in FIGS. 10–11. As suggested by the common last two digits of many of the reference numerals, the exercise machine 200 is similar in many respects to the exercise machine 100. In fact, the only significant difference involves the manner in which the body support 220 is movably mounted on the frame 210. In this regard, on each side of the machine 200, first and second links 251 and 252 are pivotally interconnected between respective points on stanchion 212 and respective points on body support 220. The associated pivot axes may be arranged to establish a desired relationship between movement of the body support 220 and change in the distance between the user's hips and ankles.

Like its counterpart on the first embodiment 100, the body support 220 preferably includes both a seat 221 and a back rest 222 that extend approximately perpendicular to one another. Also, left and right handles 229 project outward from opposite sides of the body support 220, preferably at a location directly beneath the seat 221. A bracket 224 extends downward and rearward from the back rest 222 to support a selectively variable amount of weight in the form of weight plates like the one designated as 125. The stanchions 212 extend upward from a floor engaging base 211. A forward stanchion 213 also extends upward from the base 211 to support a foot platform 230. The foot platform 230 is depicted as fixed to the frame 210, but may be made adjustable and/or movable in the same manner as its counterpart on the first embodiment 100.

Another embodiment of the present invention is designated as 300 in FIGS. 12–13. As suggested by the common last two digits of many of the reference numerals, the exercise machine 300 is similar in many respects to the exercise machines 100 and 200. In fact, the only significant difference again involves the manner in which the body support 320 is movably mounted on the frame 310. In this regard, on each side of the machine 300, a first link 352 is pivotally interconnected between stanchion 312 and an intermediate portion of bracket 323 on the body support 320, and a second link 354 is pivotally interconnected between base 311 and a forward distal end of bracket 323. Like on the previous embodiment 200, the associated pivot axes may be arranged to establish a desired relationship between movement of the body support 320 and change in the distance between the user's hips and ankles.

Like its counterparts on the embodiments 100 and 200, the body support 320 preferably includes both a seat 321 and a back rest 322 that extend approximately perpendicular to one another. Also, left and right handles 329 project outward from opposite sides of the body support 320, preferably at a location directly beneath the seat 321. A bracket 324 extends downward and rearward from the back rest 322 to support a variable amount of weight in the form of weight plates like the one designated as 125. The stanchions 312 extend upward from a floor engaging base 311. A forward stanchion 313 also extends upward from the base 311 to support a foot platform 330. The foot platform 330 is depicted as fixed to the frame 310, but may likewise be made adjustable and/or movable.

Another embodiment of the present invention is designated as 400 in FIGS. 14–15. The machine 400 includes a frame 410 having a base 411 configured to rest upon a floor surface. On each side of the frame 410, a stanchion 412 extends upward from the base 411. Left and right brackets 423 are pivotally mounted on respective stanchions 412 and rigidly connected to respective sides of a body support 420. The body support 420 preferably includes both a seat 421 and a back rest 422 that extend approximately perpendicular to one another. The relative positions of the seat 421 and the brackets 423 are such that the pivot axis of the body support 420 approximately aligns with the hips of the person P. Left and right handles 429 project outward from opposite sides of the body support 420, preferably beneath the seat 421.

First and second vertical links 432 and 433 have lower ends that are pivotally mounted on a forward end of the base 411 at respective locations. A horizontal link 431 has discrete forward portions that are pivotally connected to opposite, upper ends of respective links 432 and 433, and a rearward distal end that is rigidly connected to a foot platform 430. The distance between the lower ends of the links 432 and 433 is greater than the distance between the upper ends of the links 432 and 433. As a result of this arrangement, the foot platform 430 rotates in a first direction (counter-clockwise from FIG. 14 to FIG. 15) while moving in an opposite, second direction (clockwise from FIG. 14 to FIG. 15) relative to the frame 410. The rest orientation of the foot platform 430 may be made adjustable, if so desired.

A forward end of a first connector link 463 is rigidly connected to a lower portion of the link 433. An opposite, rearward end of the first connector link 463 is pivotally connected to a forward end of a second connector link 462. An opposite, rearward end of the second connector link 462 is pivotally connected to the right side bracket 423 at a location approximately six inches above the pivot axis for the body support 420. This connector arrangement is such that a pivot axis defined at the juncture of the links 462 and 463 is disposed above a line drawn between the associated pivot axis on the bracket 423 and the associated pivot axis on the base 411. As a result of this arrangement, the body support 420 and the foot platform 430 are constrained to rotate in opposite directions.

The components of the machine 400 may be arranged and configured to establish a desired relationship between movement of the foot platform 430 and change in the distance between the user's hips and ankles. On this embodiment 400, pivoting of the body support 420 does not significantly affect the distance between the user's hips and ankles (because the associated pivot axis is aligned with the user's hips). Like the other embodiments, the apparatus 400 also includes a means for resisting increased separation between the user's hips and ankles. On this embodiment 400, a weight stack arrangement is provided in lieu of a weight plate bracket, primarily to emphasize that the present invention is not limited to any particular type of resistance arrangement. More specifically, a cable 489 has a first end that is connected to the foot platform 430, an intermediate portion that is routed about pulleys 490 on the frame 410, and an opposite, second end that is connected to a selectively variable amount of weight 488 on a weight stack that operates in a manner known in the art.

Another embodiment of the present invention is designated as 500 in FIGS. 16–17. As suggested by the common last two digits of many of the reference numerals, the exercise machine 500 is similar in many respects to the exercise machine 400. In fact, the only significant differences involve the manner in which the foot platform 530 is movably mounted on the frame 510 and linked to the body support 520 and the resistance device. In this regard, the foot platform 530 is rigidly mounted on the lower end of a pivot arm 536 that in turn, is pivotally mounted on the frame 510 at a pivot axis that is approximately at eye level of the person P.

A pulley 538 is rotatably mounted on an intermediate portion of the pivot arm 536, and an intermediate portion of a cable 589 is routed about the pulley 538, as well as pulleys 590 on the frame 510. A first end of the cable 589 is connected to the frame 510, and an opposite, second end of the cable 589 is connected to a selectively variable amount of weight 588 on a weight stack. As a result of this arrangement, the weight 588 moves at twice the rate of the pulley 538.

A connector link 560 has a forward end that is pivotally connected to an intermediate portion of the pivot arm 536, and a rearward end that is pivotally connected to the body support 520, about half-way up the back rest 522. As on the other embodiments discussed above, a seat 521 preferably extends approximately perpendicularly away from the lower end of the back rest 522, and handles 529 project outward from opposite sides of the seat 521. As on the previous embodiment 400, the body support 520 and the foot platform 530 are constrained to rotate in opposite directions. Also, the body support 520 is pivotally mounted between left and right stanchions 512 that extend upward from opposite sides of the base 511, and the pivot axis for the body support 520 is approximately aligned with the hips of the person P. Hence, movement of the body support 520 does not significantly affect the distance between the user's hips and ankles, and the machine 500 is configured and arranged to establish a desired relationship between movement of the foot platform 530 and change in the distance between the user's hips and ankles.

Yet another embodiment of the present invention is designated as 600 in FIGS. 18–19. The apparatus 600 includes a frame 610 having a base 611 configured to rest upon a floor surface. A first, rearward stanchion 612 extends upward from the base 611, and a forward end of a rail 670 is pivotally connected to an upper portion thereof. A second, forward stanchion 613 extends upward from the base 611, and a foot platform 630 is mounted on an upper portion thereof. As on certain other embodiments, provisions may be made for adjusting the location and/or the orientation of the foot platform 630 relative to the frame 610.

A car or skate 627 is rollably mounted on the rail 670 in a manner known in the art, and a body support 620 is rigidly mounted on the car 627. As on the other embodiments, the body support 620 preferably includes both a seat 621 and a back rest 622 that extend approximately perpendicular to one another, and left and right handles 621 that project outward from opposite sides of the seat 621. An offset arm 675 extends perpendicularly away and downward from the rail 670, and a connector plate 651 has a first portion that is pivotally connected to a distal end of the offset arm 675. A rocker link 650 is pivotally interconnected between the base 611 and a second portion of the connector plate 651, and a connector link 652 is pivotally interconnected between the car 627 and a third portion of the connector plate 651. As a result, movement of the body support 620 along the rail 670 is linked to rotation of the rail 670 relative to the stanchion 612. More specifically, as the body support 620 travels rearward along the rail 670, the rail 670 (and the body support 620) pivots upward and forward relative to the frame 610. This embodiment 600 is configured and arranged in such a manner that the body support 520 both rotates and translates to accommodate change in the distance between the user's hips and ankles.

For purposes of providing resistance to rearward movement of the body support 620, a cable 689 has a first end connected to the car 627 and/or the body support 620, an intermediate portion routed about pulleys 690 on the frame 610, and an opposite, second end connected to a selectively variable amount of weight 688 in a weight stack that operates in a manner known in the art.

Still another embodiment of the present invention is designated as 700 in FIGS. 20–21. The apparatus 700 includes a frame 710 having a base 711 configured to rest upon a floor surface, a rearward stanchion 712 that extends upward from the base 611, and a forward stanchion 713 that extends upward from the base 611. A generally L-shaped link 750 has an intermediate, curved portion that is pivotally connected to an upper end of the rearward stanchion 712 at pivot axis Q.

A first distal portion of the L-shaped link 750 extends generally upward from the pivot axis Q, and terminates at a distal end that is pivotally connected to a forward end of a bracket 723. An opposite, rearward end of the bracket 723 is rigidly connected to a central portion of a back rest 722. A lower end of the back rest 722 is preferably connected to a seat 721, and handlebars 729 preferably project outward from opposite sides of the seat 721. The back rest 722 and the seat 721 are collectively designated as a body support 720, with the understanding that the back rest 722 alone would function as a suitable body support on the machine 700 (and/or any of the other embodiments described above).

A second distal portion of the L-shaped link 750 extends generally forward from the pivot axis Q, and terminates at a distal end that is pivotally connected to an intermediate portion of a connector link 753. A foot platform 730 is mounted on an intermediate section of this portion of the L-shaped link 750. As on certain other embodiments, provisions may be made for adjusting the location and/or the orientation of the foot platform 730. In this case, a sleeve or tube 733 is rigidly connected to a lower end of the foot platform 730, and slidably mounted on the intermediate section of the L-shaped link 750. A fastener 734 is inserted through an opening in the sleeve 733 and any of several holes 735 in the L-shaped link 750 to selectively lock the sleeve 733 (and the foot platform 730) in a desired position along the L-shaped link 750.

A drawbar link 752 is pivotally interconnected between a lower distal end of the connector link 753 and a lower end of the body support 720 (proximate the juncture between the back rest 722 and the seat 721). Also, a rocker link 754 is pivotally interconnected between an upper distal end of the connector link 753 and an upper distal end of the forward stanchion 713. As a result, the foot platform 730 and the body support 720 are constrained to rotate in opposite directions. The components are configured and arranged to establish a desired relationship between change in the distance between the user's hips and ankles, and movement of the body support 720, and movement of the foot platform 730. As on the other embodiments, various known resistance means may be used for resisting increased separation between the user's hips and ankles.

Compared to the prior art leg press machine shown in FIGS. 8–9, the various embodiments of the present invention similarly place a user's legs in compression and thereby provide a closed chain exercise. However, the present invention also maintains a user's upper legs perpendicular to his torso throughout the range of exercise motion, thereby isolating his quadriceps muscles (and/or incapacitating his gluteal muscles). This immobilization of the user's upper legs, which does not occur on the leg press machine shown in FIGS. 8–9, is comparable to what occurs on the prior art leg extension machine shown in FIGS. 6–7. In other words, the present invention targets the same muscles or provides the same exercise stroke as a leg extension machine, but operates in closed chain fashion (like a leg press machine).

The present invention has been described with reference to specific embodiments and particular methods of exercise associated therewith, and this disclosure will enable persons skilled in the art to derive additional embodiments and/or variations which nonetheless incorporate the essence of the present invention. Among other things, various features shown on and/or described with reference to a particular embodiment may often be applied to other embodiments, as well. Those skilled in the art will also recognize that some of the depicted linkage arrangements are preferably implemented with corresponding right and left side assemblies in order to better distribute forces associated with operation of the machine, but the present invention is not limited in this regard. Recognizing that the present invention may be implemented in various ways, the scope of the present invention is to be limited only to the extent of the following claims.

What is claimed is:

1. A method of exercising a person's quadriceps muscles in isolated, closed chain fashion, comprising the steps of:

providing a frame configured to rest upon a floor surface;

providing a foot platform;

providing a back rest; and mounting the back rest and the foot platform on the frame in a manner that supports a person with his back resting against the back rest, his thighs extending at an orthogonal angle to his torso, his knees bent, and his feet on the foot platform, and allows the person to press his feet against the foot platform to straighten his legs at the knees while keeping his back against the back rest and maintaining the orthogonal angle between the person's thighs and torso.

2. The method of claim 1, wherein the mounting step involves mounting the back rest on the frame for rotational movement relative to the frame in response to change in distance between the user's hips and ankles.

3. The method of claim 2, wherein the mounting step involves mounting the foot platform on the frame for rotational movement relative to the frame in response to change in distance between the user's hips and ankles.

4. The method of claim 3, wherein the mounting step involves linking movement of the foot platform to movement of the back rest.

5. The method of claim 4, wherein the mounting step involves constraining the foot platform and the back rest to rotate in opposite directions.

6. A method of exercising a person's quadriceps muscles in isolated, closed chain fashion, comprising the steps of:

providing a frame to rest upon a floor surface;

providing a foot platform;

providing a back rest; and mounting the back rest and the foot platform on the frame in a manner that supports a person's legs in a closed chain disposed between the back rest and the foot platform, during movement between a rest position, wherein his legs are relatively bent at the knees and his thighs are perpendicular to his torso, and an extended position, wherein his legs are relatively straight at the knees, and his thighs are still perpendicular to his torso.

7. The method of claim 6, wherein the mounting step involves mounting the back rest on the frame for rotational movement relative to the frame in response to change in distance between the user's hips and ankles.

8. The method of claim 7, wherein the back rest rotates about a center of rotation that is aligned with the user's hips.

9. The method of claim 7, wherein the back rest rotates about a center of rotation that is disposed in front of the user's chest.

10. The method of claim 7, wherein the back rest rotates about an axis that moves relative to the frame in response to change in distance between the user's hips and ankles.

* * * * *